US005847298A

United States Patent [19]

Adams

[11] Patent Number: 5,847,298

[45] Date of Patent: Dec. 8, 1998

[54] SUPPLEMENTAL FRET ATTACHMENT FOR MUSICAL STRINGED INSTRUMENT

[76] Inventor: Brian T. Adams, 701 N. Outagamie Ct., Appleton, Wis. 54914

[21] Appl. No.: 810,011

[22] Filed: Mar. 4, 1997

[51] Int. Cl.[6] ..... G10D 3/06

[52] U.S. Cl. ..... 84/314 R; 84/315

[58] Field of Search ..... 84/314 R, 298, 84/299, 307, 309, 263, 267

[56] References Cited

U.S. PATENT DOCUMENTS

| | | | |
|---|---|---|---|
| 1,684,467 | 9/1928 | Boothe | 84/263 |
| 3,910,152 | 10/1975 | Kusakawa | 84/307 |
| 4,297,936 | 11/1981 | Mouton | 84/314 R |
| 4,722,260 | 2/1988 | Pigozzi | 84/314 R |
| 4,852,450 | 8/1989 | Novak | 84/314 R |
| 5,404,783 | 4/1995 | Feiten et al. | 84/298 |
| 5,567,903 | 10/1996 | Coopersmith et al. | 84/723 |

*Primary Examiner*—William M. Shoop, Jr.
*Assistant Examiner*—Shih-yung Hsieh
*Attorney, Agent, or Firm*—Andrus, Sceales, Starke & Sawall

[57] ABSTRACT

A guitar includes a guitar body having a bridge, and an elongated neck having a first end connected to the guitar body and a second end joined to a head having a series of tuning pegs. A plurality of vibratable musical strings is stretched along the length of the neck between the tuning pegs and the bridge. A plurality of longitudinally spaced frets is fixedly mounted on the neck in spaced relationship beneath the strings. Each of the strings is adapted to be depressed against any one of the frets to produce a note of a particular pitch. The interval between a first note associated with one fret and a second note with the same name associated with another fret defines at least one octave unit. A fret attachment is disposed upon the guitar body between the first end of the neck and the bridge and is spaced beneath at least one of the strings. The fret attachment cooperates with at least one of the strings to define an additional octave level at which a third note sounds substantially identical to the second note at a higher pitch.

10 Claims, 9 Drawing Sheets

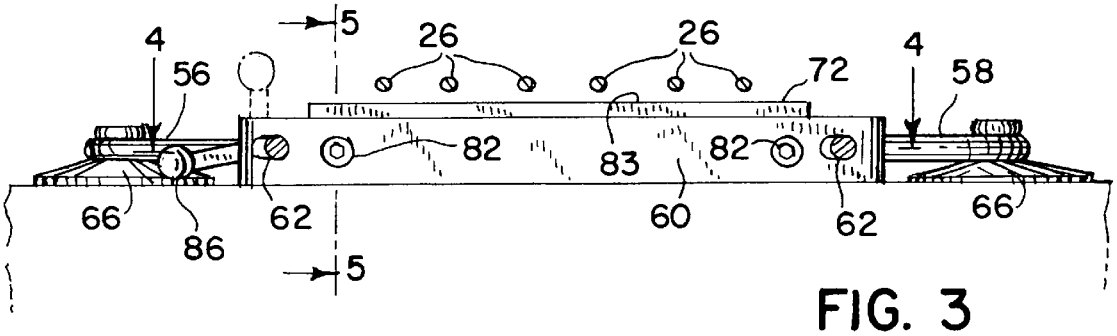
FIG. 3
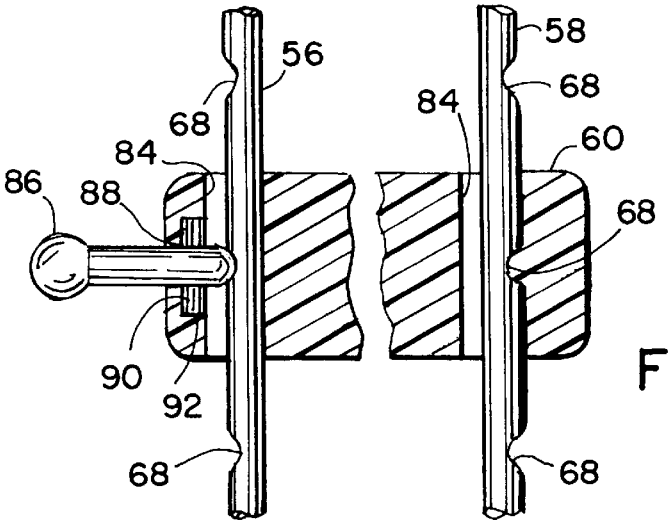
FIG. 4
FIG. 6
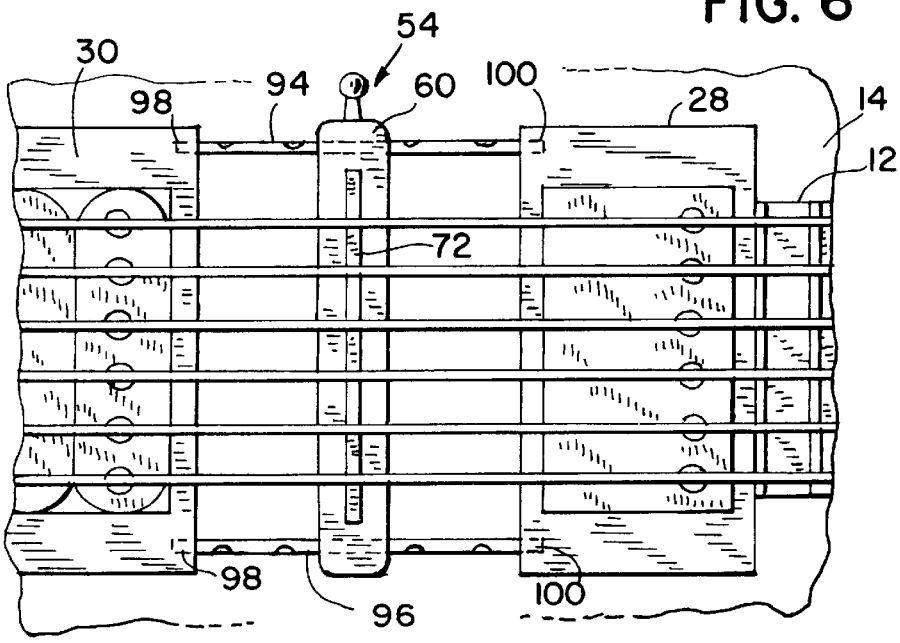

SUPPLEMENTAL FRET ATTACHMENT FOR MUSICAL STRINGED INSTRUMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates broadly to stringed musical instruments provided with frets, and more particularly, pertains to a guitar having a fret structure which will permit the creation of a fuller range of notes than has been previously available.

Electric guitar players, especially those playing lead guitar, are continually searching for new sounds and techniques which can embellish a melody and add excitement and emotion to a performance. In order to be a successful guitarist, one must have thorough knowledge and control of the horizontally fretted fingerboard running along the length of the guitar neck. Horizontal frets are metal bars which are fixedly embedded in the fingerboard throughout its length and are set at 90° angles in spaced relationship relative to the strings of the guitar. When one depresses a string down onto the fingerboard relative to the frets, the string is effectively shortened to some degree. The shorter the length of the string, the higher is the note produced by sounding and thereby vibrating the string. The longer the length of the string, the lower is the note. "Fretting" a string will produce a note with a pitch higher than that of an open, unfretted string.

Frets are strategically located according to a particular mathematical formula which helps each fret to establish a note which is a semi-tone higher than the fret below it. A special reference point on all guitars is the twelfth fret which is situated generally intermediate between the nut at the top of the neck and the bridge on the guitar body. In essence, the twelfth fret divides the length of the vibrating string in half so that the note on the twelfth fret has an identical pitch as that of an open string but is an octave higher. The fact that there are twelve frets representing twelve notes in an octave is critical to the understanding of scales and chords played on the guitar. Some of the notes are "natural" notes while others at one fret position higher than the natural note are sharp notes, and those at one fret position below the natural note are flat notes. Still other notes called "harmonics" are obtained by sounding a string while slightly damping specific frets. As one proceeds down the fingerboard towards the guitar body, the spaces between the frets grow progressively smaller and the fretted strings produce higher tones which are particularly distinctive in lead guitar playing.

Many of today's electric guitars having 21 or 22 frets are designed with one octave level while guitars with 24 frets can offer an additional octave level at the very bottom of the neck. Additional frets cannot be indiscriminately added because they would make the length of the neck too long for the reach of the guitar player. As a result, there has been a limit as to the availability of high pitched notes due to the existing fret structure on contemporary electric guitars.

It is thus desirable to provide a stringed musical instrument, in the preferred form of an electric guitar, having a supplemental fret attachment positioned on the guitar body for producing a matrix of new natural notes, sharps, flats and harmonics having pitches higher than those notes produced at frets fixed on the neck. It is also desirable to provide a supplemental fret attachment which will improve the musical range of a guitar by creating an additional octave level which is conveniently accessible adjacent the lowermost fret on the neck of the guitar. It is further desirable to provide a supplementary fret attachment which is adjustable on the guitar body between the neck and the bridge of the guitar.

BRIEF SUMMARY OF THE INVENTION

The present invention advantageously provides a stringed musical instrument capable of producing a fuller range or register of notes conducive to forming new musical compositions.

In one aspect of the invention, a stringed musical instrument has an instrument body, an elongated neck connected to the instrument body, a plurality of vibratable musical strings stretched along the length of the neck, and a plurality of longitudinally spaced frets mounted on the neck in spaced relationship to the strings. Each of the strings is adapted to be depressed relative to the frets to produce a note of a particular pitch. The improvement is defined by at least one fret attachment positioned upon the instrument body in spaced relationship relative to the strings independent of the neck. The fret attachment is constructed and arranged to help define at least one note which is higher in pitch than the same note produced at one of the frets on the neck. The fret attachment includes a base which is fixed on the instrument body and a fret bar which is adjustable relative to the base in a vertical plane towards and away from at least one of the strings.

In one alternative embodiment, the fret attachment includes at least two fret bars which are spaced apart and parallel to each other.

In another embodiment, the fret attachment is movably mounted on the instrument body. The fret attachment includes a slide track connected to the instrument body and a block slidably mounted along the slide track. The fret block has a fret bar movable towards and away from the strings. A first locking device is provided for locking the position of the fret block along the slide track in a direction along the longitudinal axis of the neck, and a second locking device is provided for locking the position of the fret bar relative to the strings. The slide track is either fixedly attached to the instrument body or adjustably attached to the instrument body such as by suction cups. The slide track is provided with indicators for positioning the fret block at various locations corresponding to a variety of notes having progressively higher pitches as the fret block is moved towards the bridge. The fret attachment includes a pair of parallel support walls having at least one pair of aligned slots, and at least one fret bar movable upwardly and downwardly on the slots and towards and away from at least one of the strings, and an actuating arrangement mounted on one of the walls for selectively bringing the fret bar into contact with the string.

In another embodiment of the invention, the instrument body includes one pick-up device located adjacent the neck and a second pick-up device located adjacent the bridge. The fret attachment is positioned between the first pick-up device and the second pick-up device. The fret attachment is connected to at least one of the pick-up devices.

In another aspect of the invention, a guitar includes a guitar body having a bridge, an elongated neck having a first end connected to the guitar body and a second end joined to a head having a series of tuning pegs, and a plurality of vibratable music strings stretched along the length of the neck between the tuning pegs and the bridge. A plurality of longitudinally spaced frets is fixedly mounted on the neck in spaced relationship beneath the strings. Each of the strings is adapted to be depressed against any one of the frets to produce a note of a particular pitch. The interval between a first note associated with one fret and a second note with the same name associated with another fret defines at least one octave level. A fret attachment is disposed between the first end of the neck and the bridge, and is spaced beneath at least one of the strings. The first attachment cooperates with at least one of the strings to define an additional octave level at which a third note sounds substantially identical to the second note at higher pitch.

In yet another aspect of the invention there is contemplated a method of creating high notes produced by a stringed musical instrument having an instrument body, an elongated neck connected to the instrument body, a plurality of vibratable musical strings stretched along the length of the neck, and a plurality of longitudinally spaced frets mounted on the neck in spaced relationship to the strings. Each of the strings is adapted to be depressed relative to the frets to produce a note of a particular pitch. The method includes the steps of positioning at least one fret arrangement on an instrument body independent of the neck and in spaced relationship to the strings; engaging at least one of the strings with the a fret attachment; and sounding the fretted string to produce a note higher in pitch than the same note produced at one of the frets on the neck.

In yet another aspect of the invention, a kit for modifying a stringed musical instrument includes an instrument body, an elongated neck connected to the instrument body, a plurality of vibratable musical strings stretched along the length of the neck, and a plurality of longitudinally spaced frets mounted on the neck in spaced relationship to the strings. Each of the strings is adapted to be engaged relative to the frets to produce a note of a particular pitch. The kit includes at least one fret attachment movably mounted on the instrument body independent of the neck and in spaced relationship to the strings. The fret attachment includes a slide track comprised of a pair of guide rods, each of the rods being adapted to be disposed in spaced parallel relationship on one side of the longitudinal axis of the neck. Each of the rods also has a pair of legs carrying respective suction cups engageable and disengageable with the instrument body. A fret block having opposite end portions is slidably mounted on the rods beneath the strings, and the fret bar is disposed substantially parallel to the frets and movably mounted on the fret block for movement toward and away from the strings. Each of the rods includes notches for locating the end portions of the fret block. The notches correspond to notes which rise in pitch as the fret block moves along the guide rods in the direction of the bridge.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings:

FIG. 3 is a partial cross-sectional view of the supplementary fret attachment taken on line 3—3 of FIG. 2;

FIG. 4 is a fragmentary cross-sectional view taken on line 4—4 of FIG. 3;

FIG. 6 is an enlarged, fragmentary plan view of a first alternative embodiment of the invention;

DETAILED DESCRIPTION OF THE INVENTION

The present invention contemplates a fret structure incorporated within a stringed musical instrument and provides distinct advantages over the prior art as will be described and appreciated hereafter. In the preferred embodiment, the stringed musical instrument takes the preferred form of a six string, solid body electric guitar. However, it should be understood that the invention can also apply to other similar stringed musical instruments wherein the foreshortening of one or more vibrating strings will produce a variety of musical notes.

Figure 1:
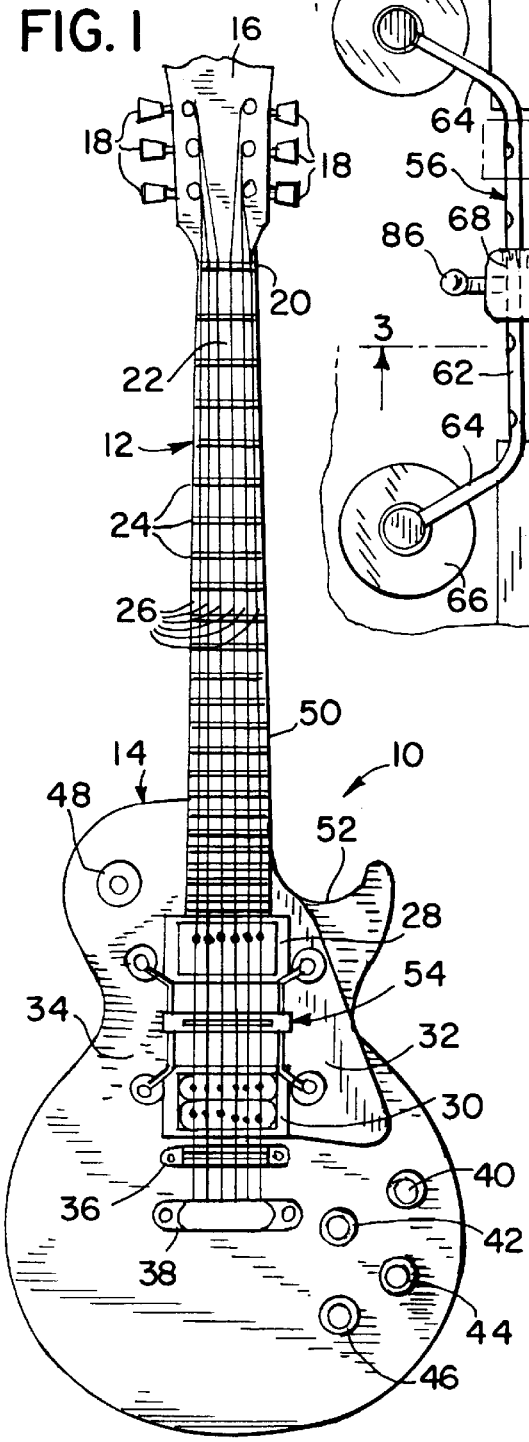
FIG. 1 is a top plan view of a conventional electric guitar employing a supplemental fret attachment constituting the present invention.

FIG. 1 depicts a conventional electric guitar 10 comprised of two major, wood-based components, namely a neck 12 and a guitar body 14. Beginning at the top of the neck 12, the guitar 10 includes a tuning head 16 having tuning pegs 18, a nut 20, a fretboard or fingerboard 22 carrying various frets 24, a set of six spaced strings 26, a front magnetic pick-up device 28, a rear magnetic pick-up device 30, a protective fingerplate 32, a soundboard 34, a bridge 36 and a tailpiece 38. Guitar 10 also typically includes a pair of volume controls 40, 42 for the pick-up devices 28, 30, a pair of tone controls 46, 46 for the pick-up devices 28, 30, and a pick-up selector switch 48. As is well known, the pick-up devices 28, 30 transform the energy of the vibrating strings into pulses which are amplified and channeled through a loudspeaker in the form of sound waves.

Strings 26 are stretched along the length of neck 12 above the fingerboard 22 between the tuning peg 16 on the upper end, and the bridge 36 and tailpiece 38 on the lower end. Tuning pegs 16 are used to primarily increase or reduce the tension exerted on each string 26, thus elevating or lowering its pitch and permitting the guitar 10 to be correctly tuned. Although not shown, the guitar 10 includes an internally mounted truss rod for maintaining the straightness of the neck 12 while the strings 24 are in tension. Nut 20 serves to hold the strings 26 in equally spaced relationship relative to one another along the longitudinal axis of the neck 12. Fingerboard 22 is often a separate piece of wood forming the upper surface of the neck 12. Frets 24 are parallel metal bars fixedly embedded into fingerboard 22 along its length in spaced relationship beneath and at right angles to the strings 26. Pressing a string 26 down against the fingerboard 22 relative to the frets 24 effectively foreshortens the length of the so-called open (unfretted) string so that "fretting" a string 26 will produce a note with a pitch higher than that of the open string. The frets 24 are spaced out at designated locations along the longitudinal axis of the neck 12 according to a particular mathematical formulation such that each fret 24 corresponds to a note a semi-tone higher than the adjacent fret below it.

As described in the Background of the Invention, the twelfth fret 50 is a standard reference point generally disposed midway between the nut 20 and the bridge 36. Any note produced from the twelfth fret 50 has the same pitch as that of an open string but is an "octave" higher. Fretted notes occurring after the twelfth fret 50 simply repeat the pattern of notes from the first through the twelfth frets 24. Most electric guitars have about 20 frets, the spacing of the frets shrinking in size in the direction of the lower end of neck 12. The design of the guitar body usually provides some type of a cutaway 52 so as to allow access to the lowermost frets 24 at which the highest pitched notes can be produced. This is generally a favored area on the guitar where lead guitar players may demonstrate their individuality in creating various musical runs or riffs. The guitar 10 shown in FIG. 1 has 22 frets so that there is one octave level at which the open string notes repeat. Some guitars have 24 frets so as to provide two octave levels and enable a greater range of musical notation. Because there are practical limits to the length of the neck 12 and the amount of frets 24 provided thereon, there has been a restriction on the attainability of further notes available to lead guitarists beyond the traditional structure of the fretted fingerboard 22.

The invention resides in the provision of a supplemental fret attachment 54 positioned remote from the neck 12 on or disposed over the guitar body 14 to create a variety of new musical notes having pitches higher than those notes produced at frets 24 on the neck 12. The invention aims to expand the musical capability of a fretted, stringed musical instrument, most notably a guitar, without drastically modifying the basic structure thereof. Such objective is attained by locating the supplemental fret attachment 54 in the available area between the neck 12 and the bridge 36.

Figure 2:
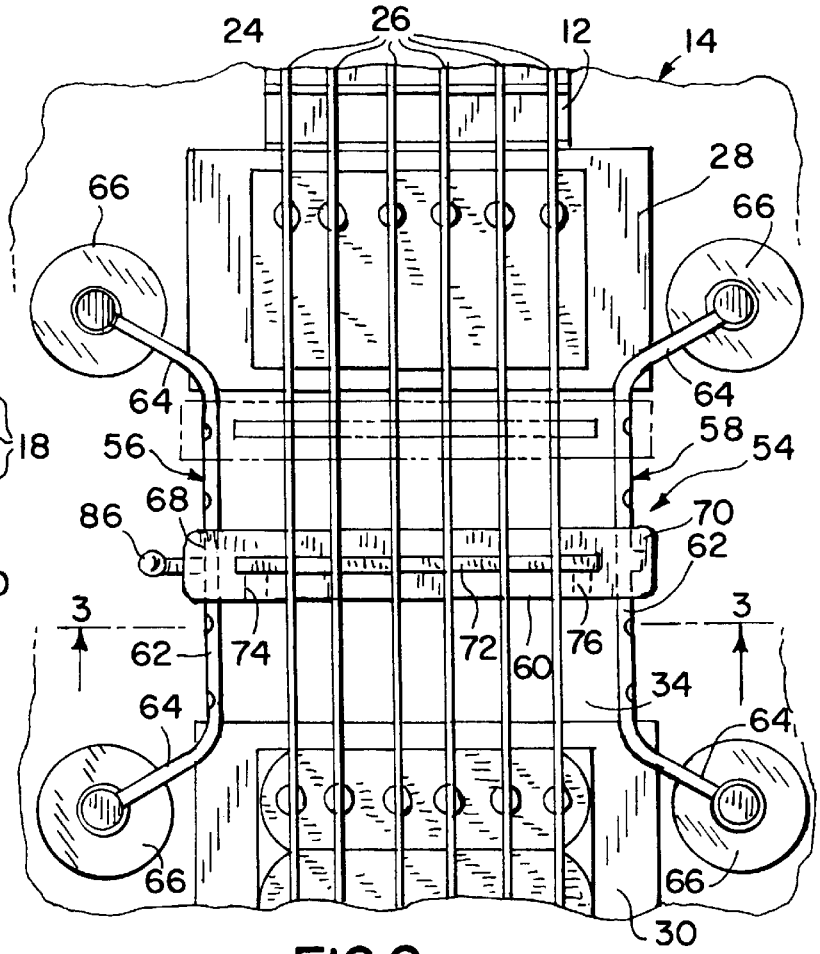
FIG. 2 is an enlarged, fragmentary plan view of the supplemental fret attachment shown in FIG. 1.

With reference to FIG. 2, the preferred embodiment of the supplemental fret attachment 54 comprises a pair of generally U-shaped guide rods 56, 58, and a fret block 60 which is slidably mounted for movement thereon (as shown in phantom) in a horizontal direction along the longitudinal axis of the neck 12. Each of the guide rods 56, 58 is preferably comprised of a metallic material such as brass and includes a straight medial portion 62 and a bent leg portion 64 on each end. Each leg portion 64 carries a removable suction cup 66 which is used to selectively position the guide rods 56, 58 on the guitar body 14. Grooves or notches 68 are formed along the medial portion 62 and function as indicators for positioning the fret block 60 at various discrete locations corresponding to a variety of notes having progressively higher pitch as the fret block 60 is moved towards the bridge 36.

Figure 5:
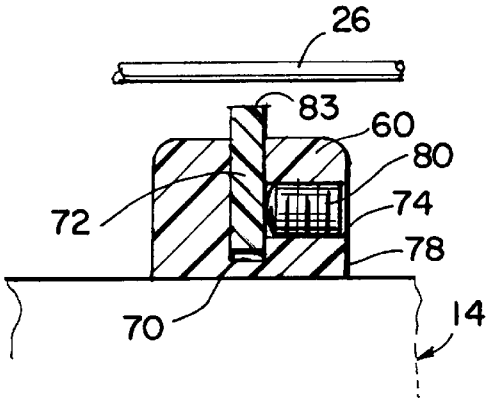
FIG. 5 is a cross-sectional view taken on line 5—5 of FIG. 3.
Figure 7:
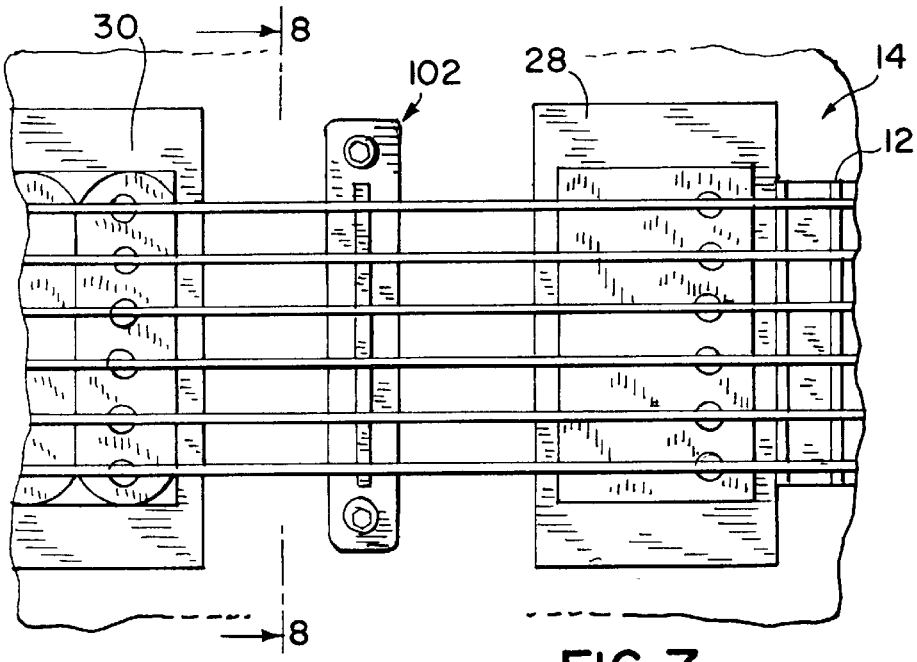
FIG. 7 is an enlarged, fragmentary plan view of a second alternative embodiment of the invention.
Figure 8:
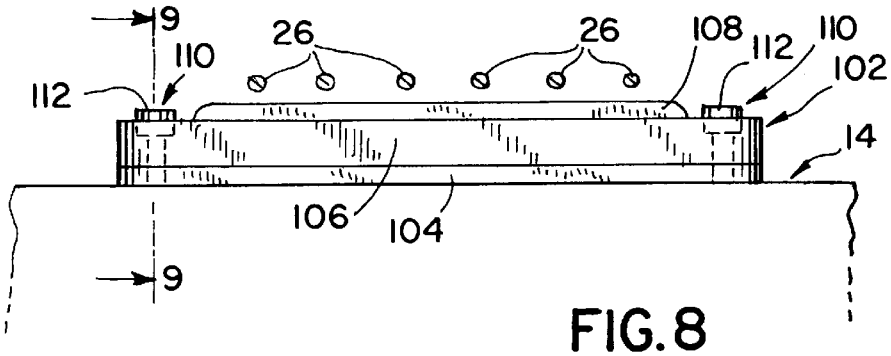
FIG. 8 is cross-sectional view taken on line 8—8 of FIG. 7.
Figure 9:
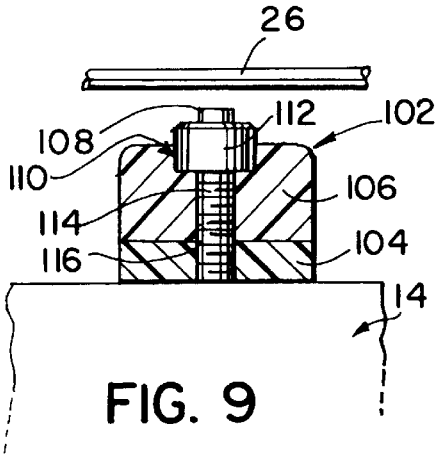
FIG. 9 is cross-sectional view taken on line 9—9 of FIG. 8 showing a portion of the supplemental fret attachment in a lowered position.
Figure 10:
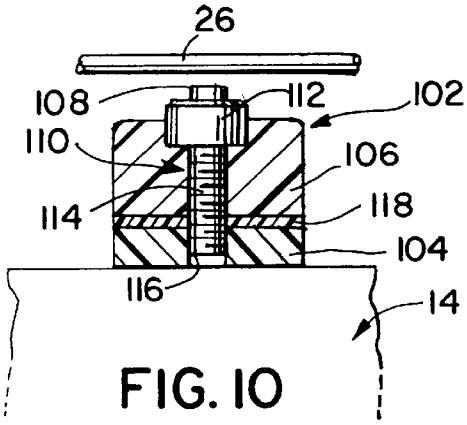
FIG. 10 is a cross-sectional view similar to FIG. 9, but showing the portion of the supplemental fret attachment in a raised position.

As seen best in FIGS. 3–5, fret block 60 is constructed from metal or plastic, and is formed substantially across its width with a vertical slot 70 in which a metal fret bar 72 is slidably mounted for upward and downward movement. Slot 70 intersects with a pair of spaced threaded openings 74, 76 formed in the front wall 78 of the fret block 60, each of which accommodates a set screw 80 having a head 82 turnable by a conventional Allen wrench. Each set screw 80 acts as a first locking device and is selectively engageable with the fret bar 72 to hold its top fretting surface 83 at a particular distance spaced beneath strings 26. Opposite ends of the fret block 60 are formed with slots 84 through which guide rods 56, 58 pass. The left end of the fret block 60 is provided with a swing latch 86 having a nose 88 engageable and disengageable with each notch 68 in the left side guide rod 56, and a transverse cylindrical pin 90 pivotably mounted in a side recess 92 formed in the fret block 60. The swing latch 86 and notches 68 cooperate to define a second locking device in which the swing latch 86 is pivotable between a horizontal locking position shown in full lines in FIG. 3 at which the fret block 60 cannot move along the guide rods 56, 58, and an upright release position shown in phantom at which the fret block 60 may be freely adjusted along guide rods 56, 58. As observed in FIG. 2, the fret block 60 and fret bar 72 may be adjusted over the available distance between the front pick-up device 28 and the rear pick-up device 30. Although the preferred embodiment uses swing latch 86 to lock the position of fret block 60, it should be appreciated that other locking devices, such as similar to set screw 80, may also be employed to perform the same function.

The supplemental fret attachment 54 may be conveniently packaged as a kit comprised of guide rods 56, 58, suction cups 66 and at least one fret block 60 with movable fret bar 72. When it is desirable to install the supplemental fret attachment 54 on the guitar 10, one first slides fret block 60 having one end attached to one of the guide rods 56, 58 under the strings 26 so that guide rod 56 or 58 is disposed outside the outermost strings 26 on the right or left side of a guitar body 14. Next, the other of the guide rods 56 or 58 is passed through slot 84 on the other end of the fret block 60 and one or both suction cups 66 are attached on its leg portions 64. At this point, with both guide rods 56, 58 positioned outside the strings 26, suction cups 66 are pressed against the fingerplate 32 and the soundboard 34 to place the medial portions 62 of the guide rods 56, 58 substantially parallel to one another. The guide rods 56, 58 thus form a slide track on which fret block 60 is slidably adjusted. Then, tuning the guitar relative to one of the fixed frets 24 on the neck 12, the fret block 60 may be locked in the desired position using latch 86. Finally, the height of fret bar 72 is suitably adjusted relative to the overlying strings 26 so that fretting one or more of the strings 26 upon fretting surface 83 will produce a desired note or notes at pitches significantly higher than produced from fretted notes on the neck 12. For example, positioning the fret block 60 immediately adjacent the rear of pick-up device 28 (as shown in phantom in FIG. 2) will result in one range register of notes, while positioning fret block 60 towards bridge 36, such as midway between the pick-up devices 28, 30, will result in an elevated range of notes. When one specifically positions the fret block 60 relative to a fixed fret 24 which defines an existing octave level, it is possible to obtain a subsequent octave level which is duplicative of notes produced from the open strings 26. As a result of the supplemental fret attachment 54, a guitar player is able to develop new exciting sounds or notes previously unavailable and is inspired to create new guitar playing techniques which demonstrate the individual flair of the guitarist.

FIG. 6 shows a first alternative embodiment which is similar to the embodiment of FIGS. 1–5 except that a pair of straight guide rods 94, 96 are used in place of bent guide rods 56, 58. Each of the guide rods 94, 96 has one end 98 joined to front pick-up device 28 and opposite end 100 connected to rear pick-up device 30. Guide rods 94, 96 act as a slide track which is fixedly attached to the guitar body 14. Fret block 60 and movable fret bar 72 have a structure and function as described above with fret block 60 being slidably adjustable along guide rods 94, 96. This embodiment depicts the supplemental fret attachment 54 in a form which is available directly from the guitar manufacturer or which may be easily retrofitted by the guitarist or a service technician.

FIGS. 7–10 illustrate a second alternative embodiment in which a two-piece fret block 102 has a lower section or base 104 connected to the guitar body 14, and an upper section 106 having an upwardly extending fret bar 108 fixed integrally therein. In this embodiment, base 104 is preferably adhesively bonded to the guitar body but it should be understood that the base 104 can be fixedly attached by other devices such as screws or rivets, or can be removably attached by hook and loop fasteners, suction cups, or the like. A screw 110 having an Allen-type head 112 connected to upper section 106 is screwthreaded into aligned bores 114, 116 on each end of fret block 102. Turning the screws 10 counter-clockwise will move the upper section 106 and the integral fret bar 108 from a lower position in FIG. 9 to a raised position shown in FIG. 10. If desired, at least one shim 118 may be inserted in the space between base 104 and upper section 106.

Figure 11:
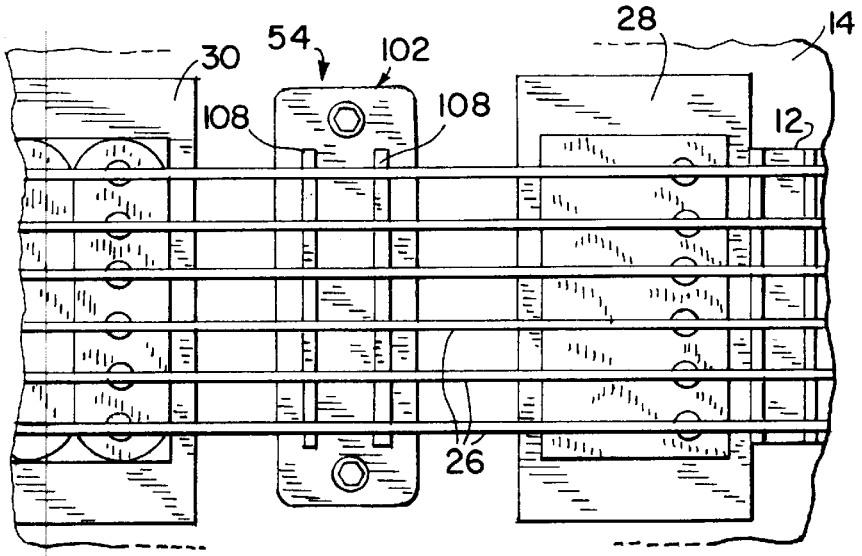
FIGS. 11–14 are enlarged, fragmentary plan views of third, fourth, fifth and sixth alternative embodiments of the invention, respectively.
Figure 12:
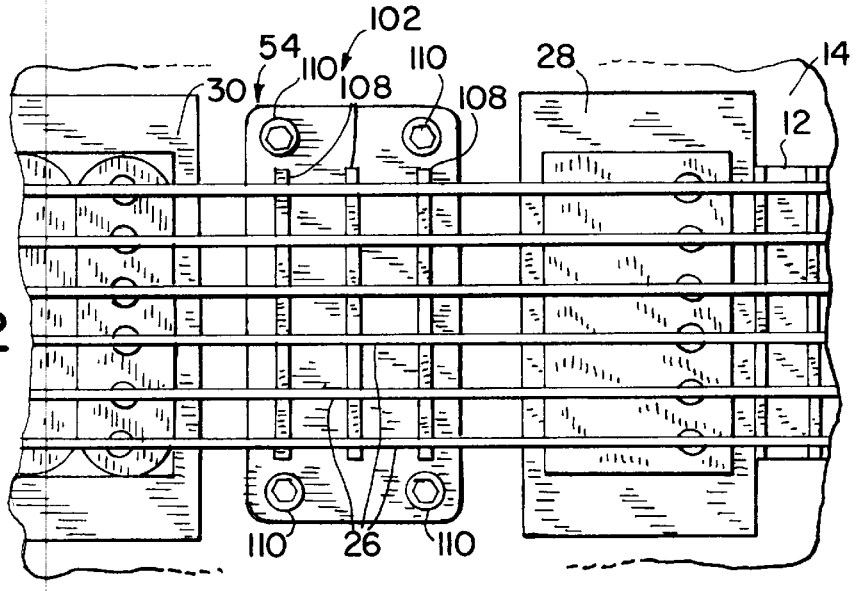
Figure 13:
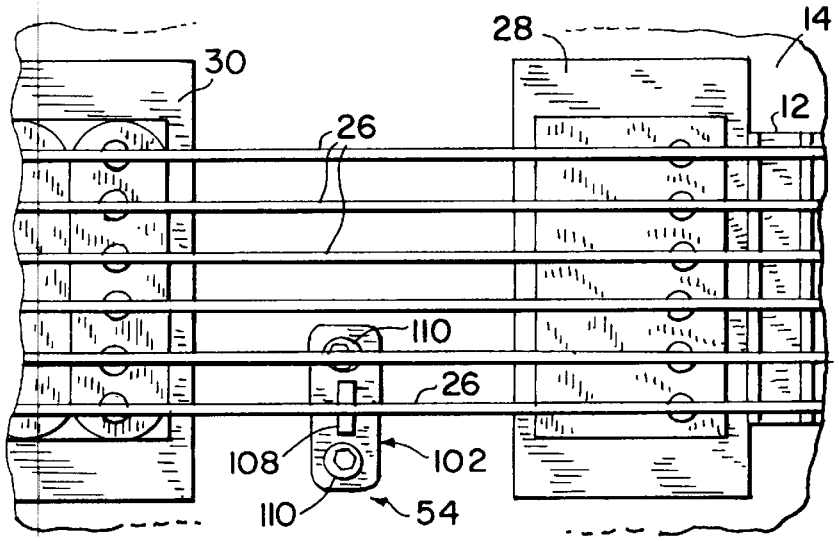

FIGS. 11–13 portray third, fourth, and fifth alternative embodiments wherein fret block 102 is formed in different shapes and sizes. FIG. 11 shows the use of an enlarged fret block 102 having a pair of fret bars 108 spaced apart and parallel to each other. FIG. 12 discloses a further enlarged fret block 102 having three fret bars spaced apart and parallel to each other and an additional pair of screws 110. FIG. 13 shows a reduced fret block 102 including a fret bar 108 having a width which will fit beneath only a single (e.g. high E) string 26.

Figure 14:
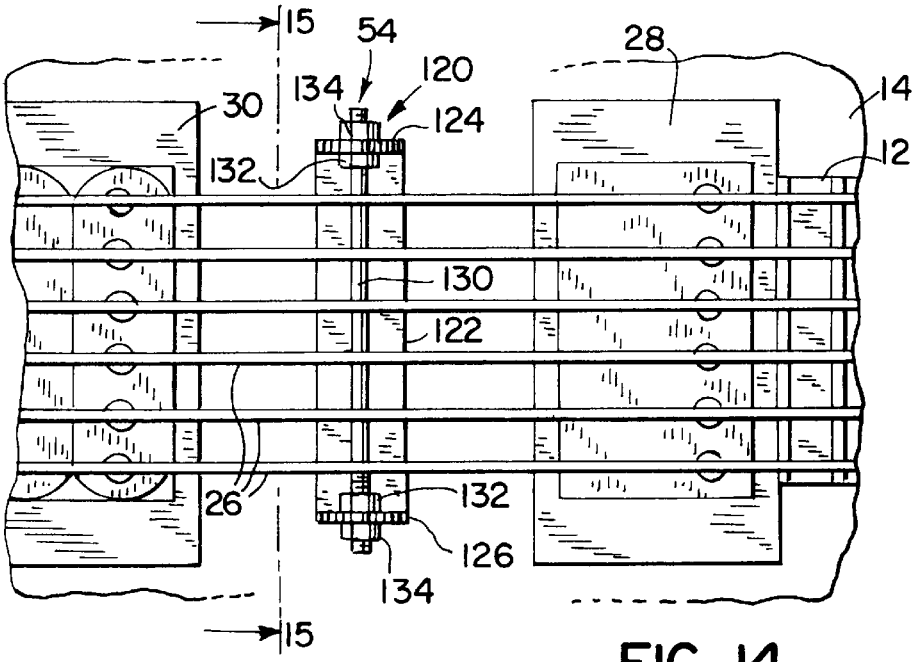
Figure 15:
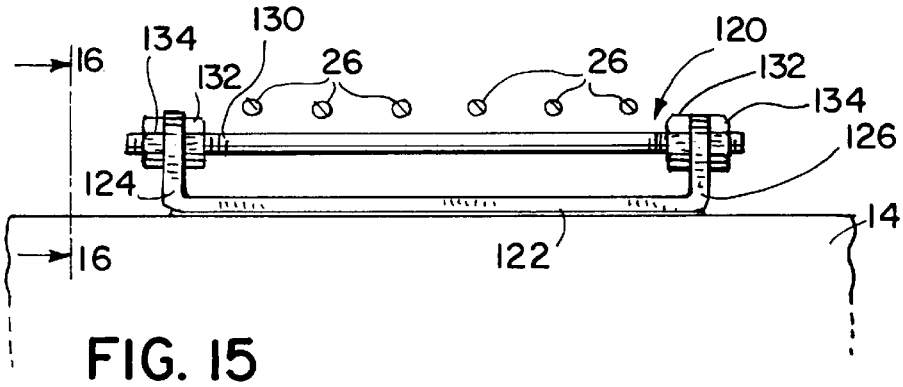
FIG. 15 is a cross-sectional view taken on line 15—15 of FIG. 14.
Figure 16:
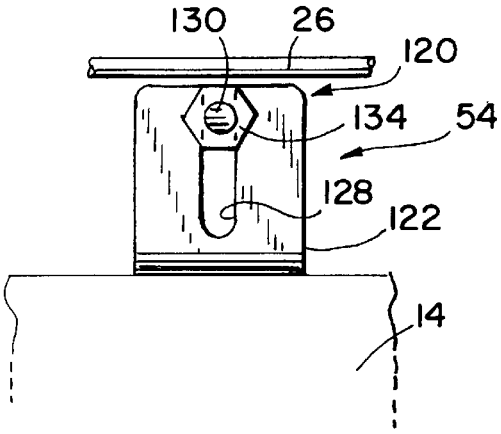
FIG. 16 is an end view taken on line 16—16 of FIG. 15.

FIGS. 14–16 depict a sixth alternative embodiment wherein a fret block 120 is comprised of a generally U-shaped base 122 which is joined to the guitar body 14. Base 122 has a pair of upstanding legs 124, 126, each of which is provided with a slot 128 in which a cylindrical fret bar 130 rides upwardly and downwardly. Each end of fret bar 130 is threaded for the reception of a pair of adjusting nuts 132, 134 which are tightly screwthreaded against respective inside and outside surfaces of legs 124, 126 so as to hold the fret bar 130 at a certain distance beneath the string 126.

Figure 17:
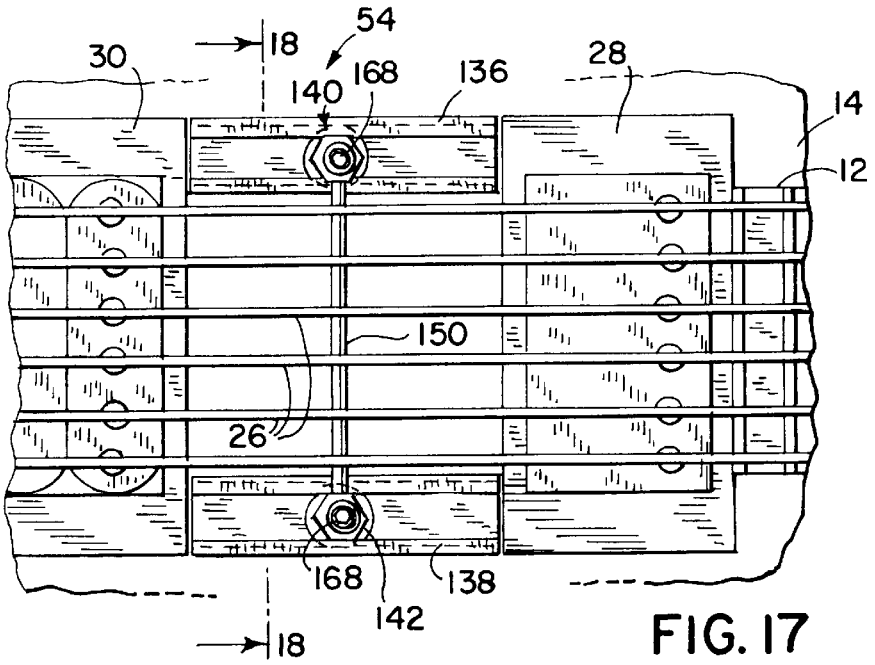
FIG. 17 is an enlarged, fragmentary plan view of a seventh alternative embodiment of the invention.
Figure 18:
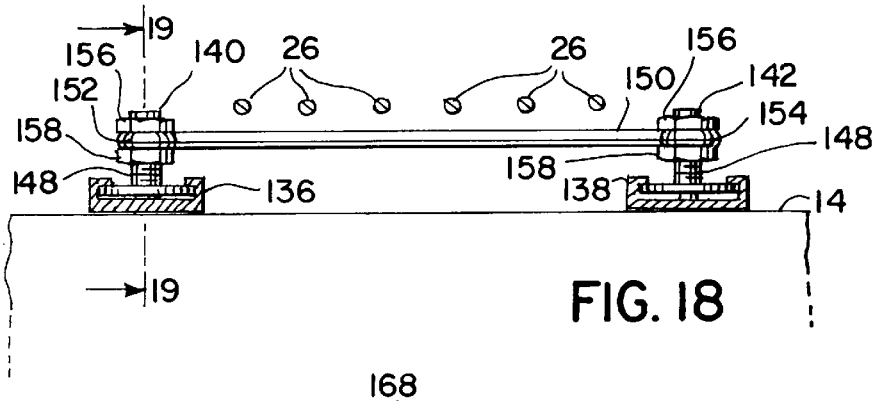
FIG. 18 is a cross-sectional view taken on line 18—18 of FIG. 17.
Figure 19:
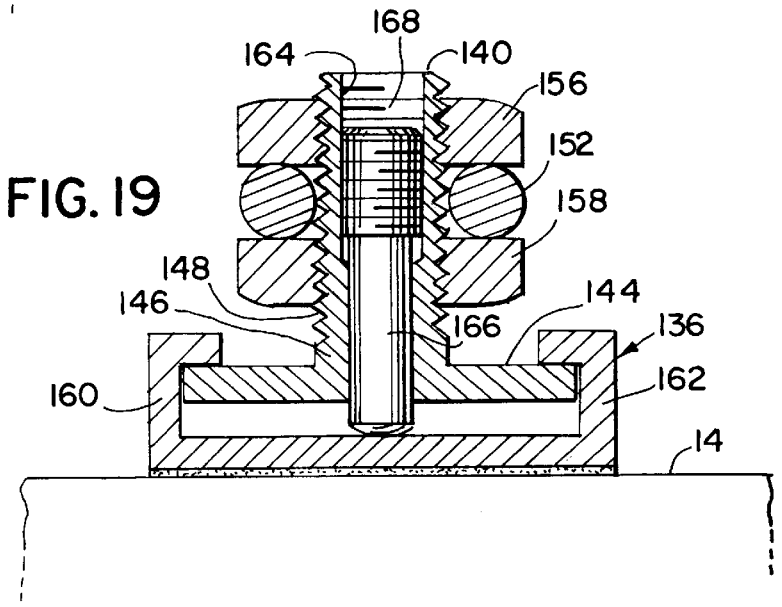
FIG. 19 is a cross-sectional view taken on line 19—19 of FIG. 18.

FIGS. 17–19 illustrate a seventh alternative embodiment wherein the supplemental fret attachment 54 includes a pair of spaced apart, parallel brackets 136, 138 extending between pick-up devices 28, 30. Brackets 136, 138 define a slide track for a pair of support spindles 140, 142. Each support spindle 140, 142 has a circular base 144 and an upright body 146 which is formed with external threads 148. A cylindrical fret bar 150 spans the distance between the spindles 140, 142 and has looped end portions 152, 154, each of which is placed over one of the threaded bodies 146 and held in place between a pair of sandwiching washers 156, 158 screwthreaded on the spindles 140, 142. Each of the brackets 136, 138 has a pair of inwardly turned sidewalls 160, 162 which define a channel 163 in which each spindle base 144 slides back and forth in a direction generally parallel to strings 26. In addition, each spindle 140, 142 is formed with internal threads 164 to receive an adjusting screw 166 having an Allen-type head 168. Once the fret bar 150 has been horizontally located, turning screws 166 downwardly against the bottom of brackets 136, 138 as seen in FIG. 19 will draw the base 144 tightly against the inside surfaces of sidewalls 160, 162. This action will maintain the horizontal position of fret bar 150. To set the fret bar 150 at the desired distance beneath the strings 26, one turns the washers 156, 158 in unison to raise or lower the fret bar 150.

Figure 20:
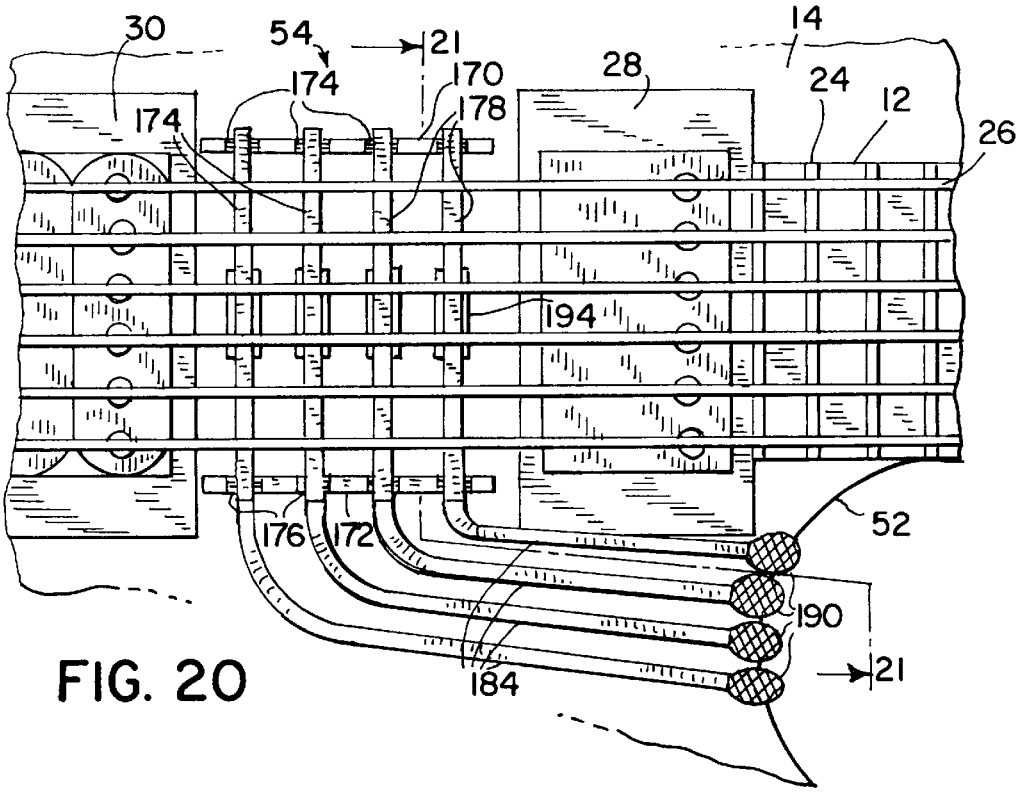
FIG. 20 is an enlarged, fragmentary plan view of an eighth alternative embodiment of the invention.
Figure 21:
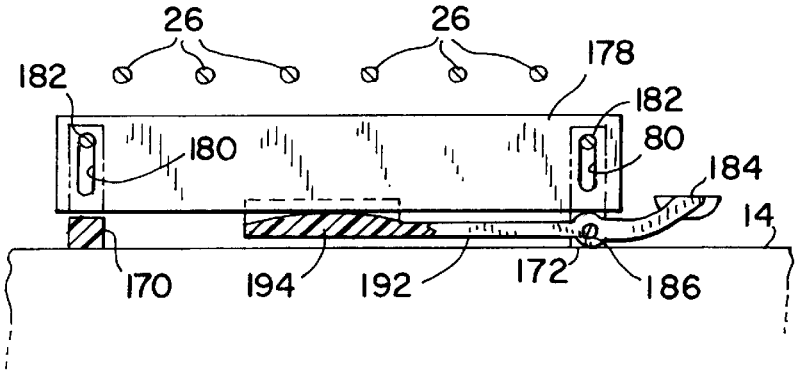
FIG. 21 is a cross-sectional view taken on line 21—21 showing a portion of the supplemental fret attachment in a lowered position.
Figure 22:
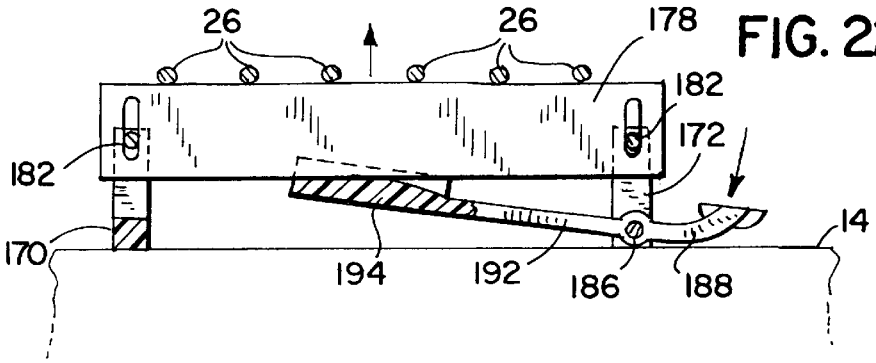
FIG. 22 is a cross-sectional view similar to FIG. 21 but showing the portion of the supplemental fret attachment in a raised position.

FIGS. 20–22 show an eighth alternative embodiment wherein supplemental fret attachment 54 includes a pair of spaced apart, parallel support walls 170, 172 which are anchored to the guitar body 14, and located between pick-up devices 28, 30. Each of the walls 170, 172 is formed with a series of slots 174, 176 for receiving a series of fret bars 178 which are guided upwardly and downwardly therein. Each of the fret bars 178 has opposite end portions provided with vertical slots 180 which cooperate with a rod 182 running along the top portion of each wall 170, 172. The rod and slot structure allows each fret bar 178 to be held suspended at a particular height h (FIG. 21). As will be appreciated, the walls 170, 172 define a slide track for the movement of fret bars 178 along a vertical plane. A series of pivot arms 184 are located adjacent the cutaway 52 of the guitar nearest the lowermost fret 24 and are pivotally mounted about horizontal pin 186 at the bottom of each wall 170, 172. Each of the pivot arms 184 includes a curved section 188 having a fingerpad 190, and a straight lever section 192 having a thickened area 194 which is selectively engageable with the bottom of fret bar 178. In this embodiment, depressing fingerpad 190 will pivot its respective lever section 192 from the FIG. 20 position to the FIG. 21 position causing the respective fret bar 178 to move upwardly into engagement with the bottom of strings 26. The fretted string may then be sounded to attain the desired effect. Fingerpad 190 may be used alone or in combination with other fingerpads 190.

Figure 24:
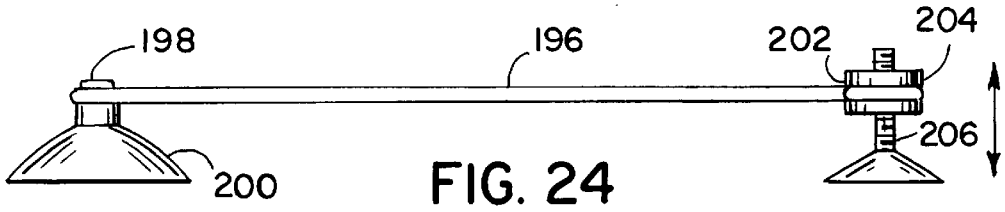
FIG. 24 is a partial cross-sectional view taken on line 24—24 of FIG. 23.
Figure 23:
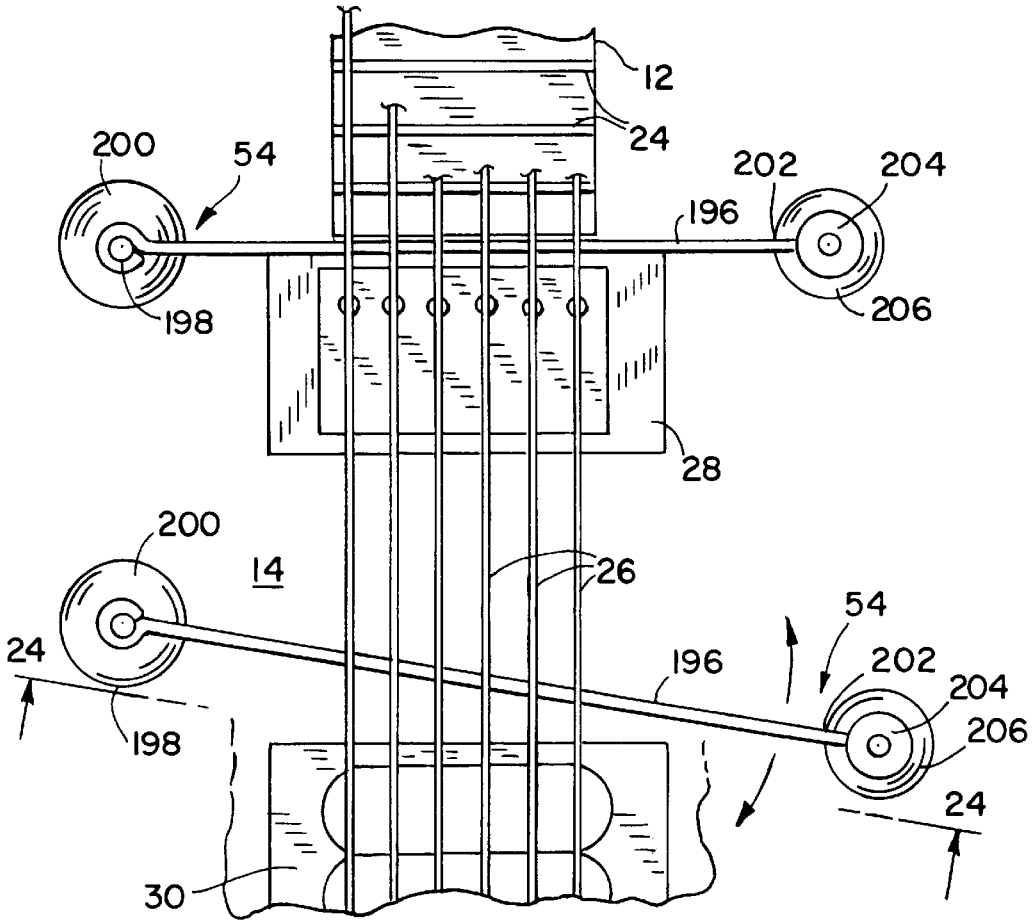
FIG. 23 is an enlarged, fragmentary plan view of a ninth alternative embodiment of the invention.

FIGS. 23 and 24 depict a ninth alternative embodiment wherein supplemental fret attachment 54 includes a wire-like fret bar 196 having one end 198 pivotally attached to a suction cup 200 and an opposite end 202 attached to a nut 204 which is screwthreaded on a spindle 206 which rests on but is not attached to the guitar body 14. As explained above, the fret bar 196 may be moved up and down relative to the strings 26 by means of the adjustment of the screwthreaded members 204, 206. In one application, the fret bar 196 is positioned immediately below the neck 12 and directly above the pick-up device 28 and is intended to remain substantially parallel to the frets 24. In another application, the fret bar 196 may be swung about end 198 and engaged about the strings 26 in a slide motion, thereby acting as a "whammy" to produce effects similar to those of sliding techniques well known to guitarists.

Figure 26:
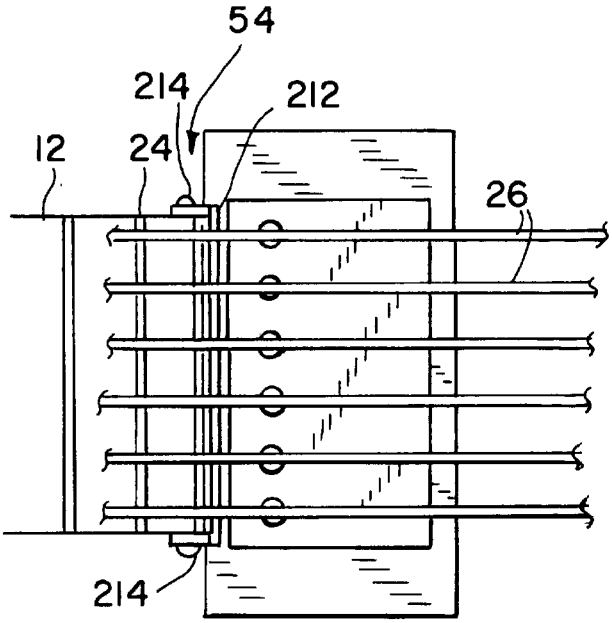
FIGS. 25 and 26 are enlarged, fragmentary plan views of tenth and eleventh alternative embodiments of the invention.
Figure 25:
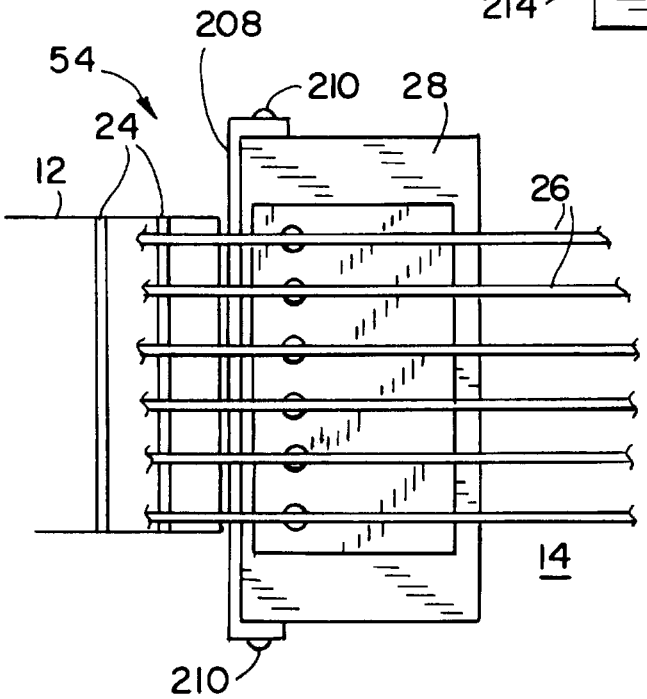
Figure 27:
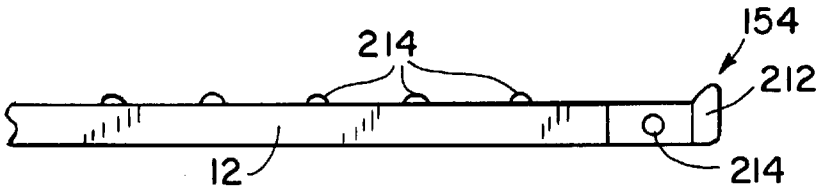
FIG. 27 is a fragmentary side view of the fret attachment of FIG. 26.

FIG. 25 shows a tenth alternative embodiment wherein supplemental fret attachment 54 has a fret bar 208 attached to one pick-up device 28 only, such as by fasteners 210. FIGS. 26 and 27 illustrate an eleventh embodiment wherein supplemental fret attachment 54 has a fret bar 212 supported by fasteners 214 on the side of neck 24 for positioning over the guitar body 14.

In each of the embodiments set forth in the specification, it should be appreciated that the fret block may be comprised of a single piece of material or may be comprised of a laminated construction including shims, spacers, etc. of various materials to attain the desired effect. It should also be noted that depending on the size and location of the pick-up device, the supplemental fret attachment may be positioned on either side of the pick-up device in the available area between the bridge and the neck. As shown herein, the supplemental fret attachment may be incorporated in the guitar at the time of manufacture, may be customized after manufacture, or may be retrofitted by the guitarist at any time.

It should now be appreciated that the present invention contemplates a supplemental fret attachment for a stringed musical instrument, such as a guitar, which is located in the existing available space on the soundboard 34 of the guitar body 14. The invention extends the existing function of the fret normally fixed on the guitar neck to produce a new range of notes especially attractive for enhancing the performance of a lead guitarist.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. In a stringed musical instrument having an instrument body, an elongated neck connected to the instrument body, a plurality of vibratable musical strings stretched along the length of the neck and terminating in a bridge positioned on the instrument body and in constant engagement with each of the strings, and a plurality of longitudinally spaced frets mounted on the neck in spaced relationship to the strings, each of the strings being depressed relative to the frets to produce a note of a particular pitch, the improvement comprising:

at least one fret attachment movably positioned upon the instrument body in spaced relationship relative to the strings, each of the strings being selectively depressed against the fret attachment to help define at least one note which is higher in pitch than the same note produced at one of the frets on the neck.

2. A guitar comprising:

a guitar body including a bridge;

an elongated neck having a first end connected to the guitar body and a second end joined to a head having a series of tuning pegs;

a plurality of vibratable musical strings stretched along the length of the neck between the tuning pegs and the bridge;

a plurality of longitudinally spaced frets fixedly mounted on the neck in spaced relationship beneath the strings, each of the strings being depressed against any one of the frets to produce a note of a particular pitch, the interval between a first note associated with one fret and a second note with the same name associated with another fret defining at least one octave level, and a fret attachment movably disposed between the first end of the neck and the bridge, and spaced beneath at least one of the strings, wherein at least one of the strings is depressed against the fret attachment to define an additional octave level at which a third note sounds substantially identical to the second note at a higher pitch.

3. A method of creating high notes produced by a stringed musical instrument having an instrument body, an elongated neck connected to the instrument body, a plurality of vibratable musical strings stretched along the length of the neck, and a plurality of longitudinally spaced frets mounted on the neck in spaced relationship to the strings, each of the strings adapted to be depressed relative to the frets to produce a note of a particular pitch, the method comprising the steps of:

movably positioning at least one fret attachment on the instrument body independent of the neck and in spaced relationship relative to the strings;

depressing at least one of the strings against the fret attachment; and sounding the fretted string to produce a note higher in pitch than the same note produced at one of the frets on the neck.

4. A kit for modifying a stringed musical instrument having an instrument body, an elongated neck connected to the instrument body a plurality of vibratable musical strings stretched along the length of the neck and a plurality of longitudinally spaced frets mounted on the neck in spaced relationship to the strings, each of the strings being depressed relative to the frets to produce a note of a particular pitch, the kit comprising:

at least one fret attachment movably mounted on the instrument body independent of the neck and in spaced relationship relative to the strings, wherein the fret attachment includes a slide track comprised of a pair of spaced guide rods, each of the rods being disposed on one side of the longitudinal axis of the neck, each of the rods also having a pair of legs carrying respective suction cups engageable and disengageable with the instrument body, a fret block having opposite end portions slidably mounted on the rods beneath the strings, and a fret bar disposed substantially parallel to the frets and movably mounted on the fret block for movement toward and away from the strings, wherein each of the rods includes notches for locating the end portions of the fret block, the notches corresponding to notes which rise in pitch as the fret block moves along the guide rods in the direction of the bridge.

5. In a stringed musical instrument having an instrument body, an elongated neck connected to the instrument body, a plurality of vibratable musical strings stretched along the length of the neck, and a plurality of longitudinally spaced frets mounted on the neck in spaced relationship to the strings, each of the strings being depressed relative to the frets to produce a note of a particular pitch, the improvement comprising:

at least one fret attachment positioned upon the instrument body in spaced relationship relative to the strings, the fret attachment constructed and arranged to help define at least one note which is higher in pitch than the same note produced at one of the frets on the neck, wherein the fret attachment includes a slide track connected to the instrument body, a fret block slidably mounted along the slide track, the fret block having a fret bar movable towards and away from the strings, a first locking device for locking the position of the fret bar relative to the strings, and a second locking device for locking the position of the fret block along the slide track in a direction along the longitudinal axis of the neck.

6. The improvement of claim 5 wherein the slide track is adjustably attached to the instrument body.

7. The improvement of claim 6 wherein the slide track is adjustably attached to the instrument body by means of suction cups.

8. The improvement of claim 5 wherein the instrument body includes a first pick-up device located adjacent the neck and a second pick-up device located adjacent the bridge.

9. The improvement of claim 8 wherein the fret attachment is positioned between the first pick-up device and the second pick-up device.

10. In a stringed musical instrument having an instrument body, an elongated neck connected to the instrument body, a plurality of vibratable musical strings stretched along the length of the neck, and a plurality of longitudinally spaced frets mounted on the neck in spaced relationship to the strings, each of the strings being depressed relative to the frets to produce a note of a particular pitch, the improvement comprising:

at least one fret attachment positioned upon the instrument body in spaced relationship relative to the strings, the fret attachment constructed and arranged to help define at least one note which is higher in pitch than the same note produced at one of the frets on the neck, wherein the fret attachment includes a slide track connected to the instrument body and a fret block slidably mounted along the slide track, the fret block having a fret bar movable towards and away from the strings, and wherein the slide track is provided with indicators for positioning the fret block at various locations corresponding to a variety of notes having progressively higher pitch as the fret block is moved towards the bridge.

* * * * *